US009366105B2

(12) United States Patent
Reimert et al.

(10) Patent No.: US 9,366,105 B2
(45) Date of Patent: Jun. 14, 2016

(54) CASING HANGER LOCKDOWN SLEEVE

(75) Inventors: Larry E. Reimert, Houston, TX (US); Denise A. M. Antunes, legal representative, Houston, TX (US); Morris B. Wade, Tomball, TX (US)

(73) Assignee: Dril-Quip, Inc., Houston, TX (US)

( * ) Notice: Subject to any disclaimer, the term of this patent is extended or adjusted under 35 U.S.C. 154(b) by 491 days.

(21) Appl. No.: 13/635,083

(22) PCT Filed: Jul. 1, 2011

(86) PCT No.: PCT/US2011/042837

§ 371 (c)(1), (2), (4) Date: Mar. 7, 2013

(87) PCT Pub. No.: WO2012/018469

PCT Pub. Date: Feb. 9, 2012

(65) Prior Publication Data

US 2013/0213671 A1 Aug. 22, 2013

Related U.S. Application Data

(60) Provisional application No. 61/368,052, filed on Jul. 27, 2010.

(51) Int. Cl.

| | |
|---|---|
| ***E21B 33/04*** | (2006.01) |
| ***E21B 33/03*** | (2006.01) |
| ***E21B 33/043*** | (2006.01) |
| ***E21B 33/035*** | (2006.01) |

(52) U.S. Cl.

CPC ..... *E21B 33/043* (2013.01); *E21B 33/035* (2013.01)

(58) Field of Classification Search

CPC ... E21B 33/03; E21B 33/035; E21B 33/0422; E21B 33/043

See application file for complete search history.

(56) References Cited

U.S. PATENT DOCUMENTS

| | | | | |
|---|---|---|---|---|
| 4,674,576 | A * | 6/1987 | Goris et al. | 166/382 |
| 5,273,117 | A | 12/1993 | Reimert | |
| 5,287,925 | A | 2/1994 | Watkins et al. | |
| 6,705,401 | B2 * | 3/2004 | Buckle et al. | 166/337 |
| 7,219,738 | B2 * | 5/2007 | Reimert | 166/348 |
| 2003/0127229 | A1 * | 7/2003 | Buckle et al. | 166/336 |
| 2004/0238175 | A1 * | 12/2004 | Wade et al. | 166/348 |
| 2009/0277645 | A1 * | 11/2009 | Pallini et al. | 166/345 |
| 2011/0005774 | A1 * | 1/2011 | Sinnott et al. | 166/380 |
| 2012/0024542 | A1 * | 2/2012 | Keat et al. | 166/382 |
| 2012/0241175 | A1 * | 9/2012 | Galle et al. | 166/387 |
| 2013/0146306 | A1 * | 6/2013 | Yates et al. | 166/382 |
| 2013/0213671 | A1 * | 8/2013 | Reimert et al. | 166/382 |
| 2013/0299193 | A1 * | 11/2013 | Duong | 166/382 |
| 2014/0096977 | A1 * | 4/2014 | Gette et al. | 166/379 |
| 2014/0158376 | A1 * | 6/2014 | Ellis et al. | 166/382 |

* cited by examiner

*Primary Examiner* — Jennifer H Gay
(74) *Attorney, Agent, or Firm* — Baker Botts L.L.P.

(57) ABSTRACT

The lockdown mechanism (10) and running tool (50) are provided for securing the casing hanger (12, 13) within the wellhead (14) and sealing the annulus between the casing and the wellhead. The lockdown ring (20) fixes the lockdown sleeve (40) to a wellhead in response to a lockdown piston (22). A first seal (24) energized by the running tool seals between the lockdown sleeve and the wellhead. Ball seat (30) is axially movable within the running tool, and a second seal also energized by the running tool (32) seals between the lockdown sleeve and the casing hanger.

22 Claims, 9 Drawing Sheets

CASING HANGER LOCKDOWN SLEEVE

CROSS REFERENCE TO RELATED APPLICATIONS

This application is a U.S. national stage application of PCT Appln. No. PCT/US11/42837 filed on Jul. 1, 2011, which claims the priority of U.S. Provisional Application No. 61/368,052 filed on Jul. 27, 2010, the disclosure of which is incorporated herein by reference for all purposes.

FIELD OF THE INVENTION

The present invention relates to a lockdown sleeve and a running tool for locking a casing hanger to a wellhead and for retrieving the lockdown sleeve, if necessary. The lockdown sleeve seals between the casing hanger and the wellhead, and the running tool allows the seals to be tested.

BACKGROUND OF THE INVENTION

Various types of lockdown sleeves (LDS) have been conceived for axially interconnecting a casing hanger and a subsea wellhead. In some applications, no seal between the casing hanger and the wellhead is provided by the lockdown sleeve. In other applications, a lockdown sleeve may be designed to seal with the casing hanger. Even when a lockdown sleeve is provided, a single seal is conventionally used to seal the annulus between the wellhead and the casing hanger.

Prior art patents include U.S. Pat. No. 5,273,117 which discloses a locking ring for locking an outer wellhead housing to an inner wellhead housing. U.S. Pat. No. 5,287,925 discloses multiple seals with the wellhead housing. U.S. Pat. No. 7,219,738 discloses a locking member and a seal between the wellhead and a seal body.

The disadvantages of the prior art are overcome by the present invention, and an improved casing hanger lockdown sleeve, running tool, and method of locking down and sealing a casing hanger to a wellhead are hereinafter disclosed.

SUMMARY OF THE INVENTION

In one embodiment, a lockdown mechanism and running tool are provided for securing a casing hanger within a wellhead and sealing an annulus between a casing supported by the casing hanger and the wellhead. A casing hanger seal supported on the casing hanger seals with the wellhead. A lockdown sleeve limits axial movement of the casing hanger with respect to the wellhead, and a redundant seal is provided between the casing hanger and the wellhead. The running tool is actuated to lock the lockdown sleeve to the wellhead. A first seal is provided for sealing between the lockdown sleeve and the wellhead. The running tool is also actuated to energize a second seal between a seal sleeve and the casing hanger, thereby providing redundant sealing of the annulus between the casing and the wellhead.

These and further features and advantages of the present invention will become apparent from the following detailed description, wherein reference is made to the figures in the accompanying drawings.

DETAILED DESCRIPTION OF PREFERRED EMBODIMENTS

Figure 1:
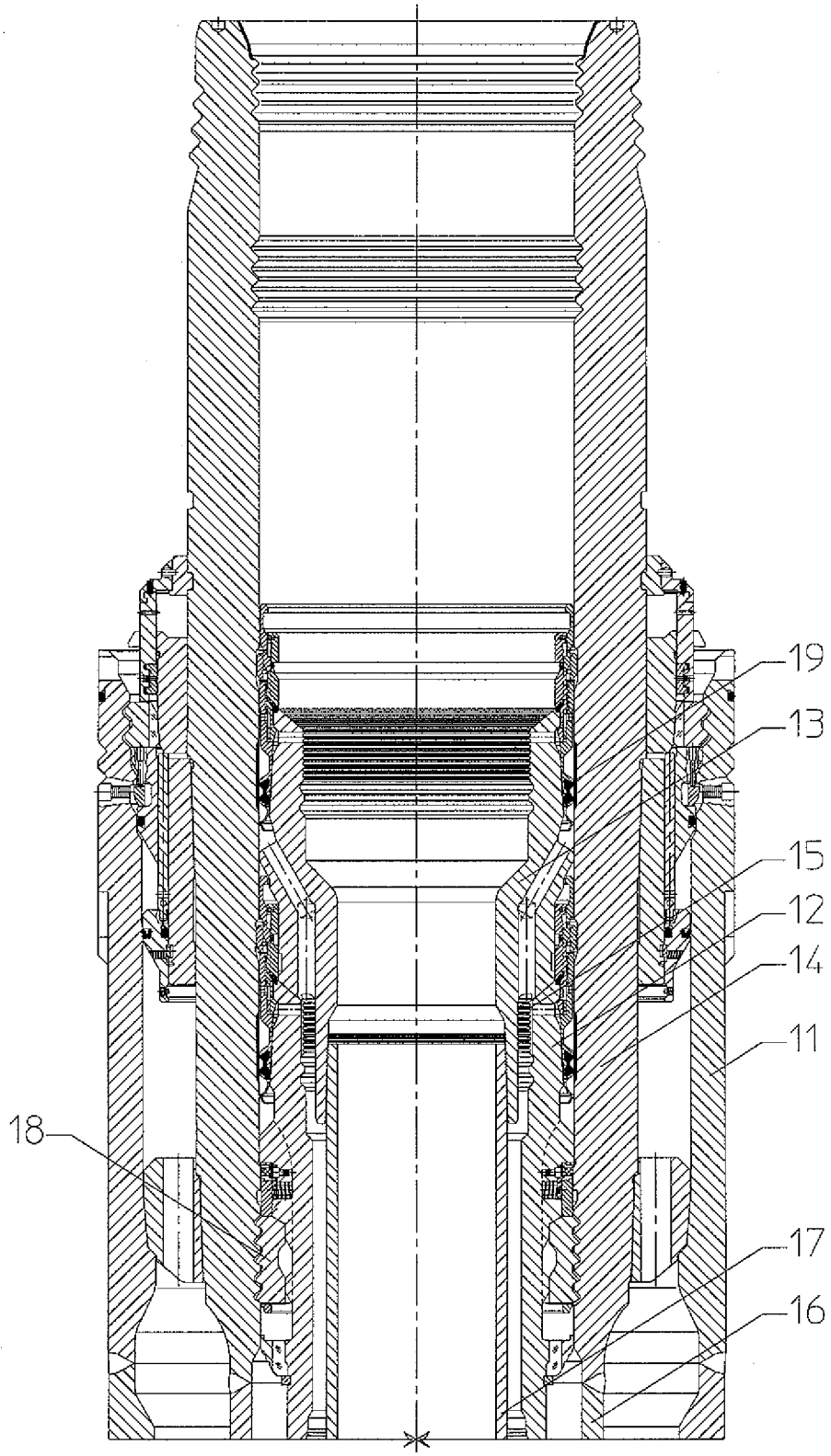
FIG. 1 is a cross-sectional view of a portion of a wellhead and a casing hanger in the wellhead.

FIG. 1 illustrates a subsea wellhead 14, an outer low pressure housing 11, an outer casing 16 extending downward from the wellhead, a lower casing hanger 12 within the wellhead, and an upper casing hanger 13 landed on the lower casing hanger and supporting the casing string 17. C-ring member 18 supports the casing hanger and thus the casing string 17 from the wellhead, and seal 19 (see FIG. 2) seals between the upper end of the upper casing hanger and the wellhead and thus seals the annulus about the casing string 17. The lower casing hanger 12 may have its own seal 15 for sealing with wellhead 14. The wellhead as described is functionally similar to prior art wellhead and casing hanger technologies, although in some instances a seal between the casing hanger and the wellhead has not been provided.

The wellhead as shown in FIG. 1 is typically used during production operations, and frequently a blowout preventer (BOP) or tieback connector is provided at the upper end of the wellhead. When these components are removed and replaced, or when these components are retrieved in conjunction with killing the well, the enhanced integrity provided by the lockdown mechanism and the enhanced sealing attributable to redundant seals overcomes significant safety concerns.

Figure 2:
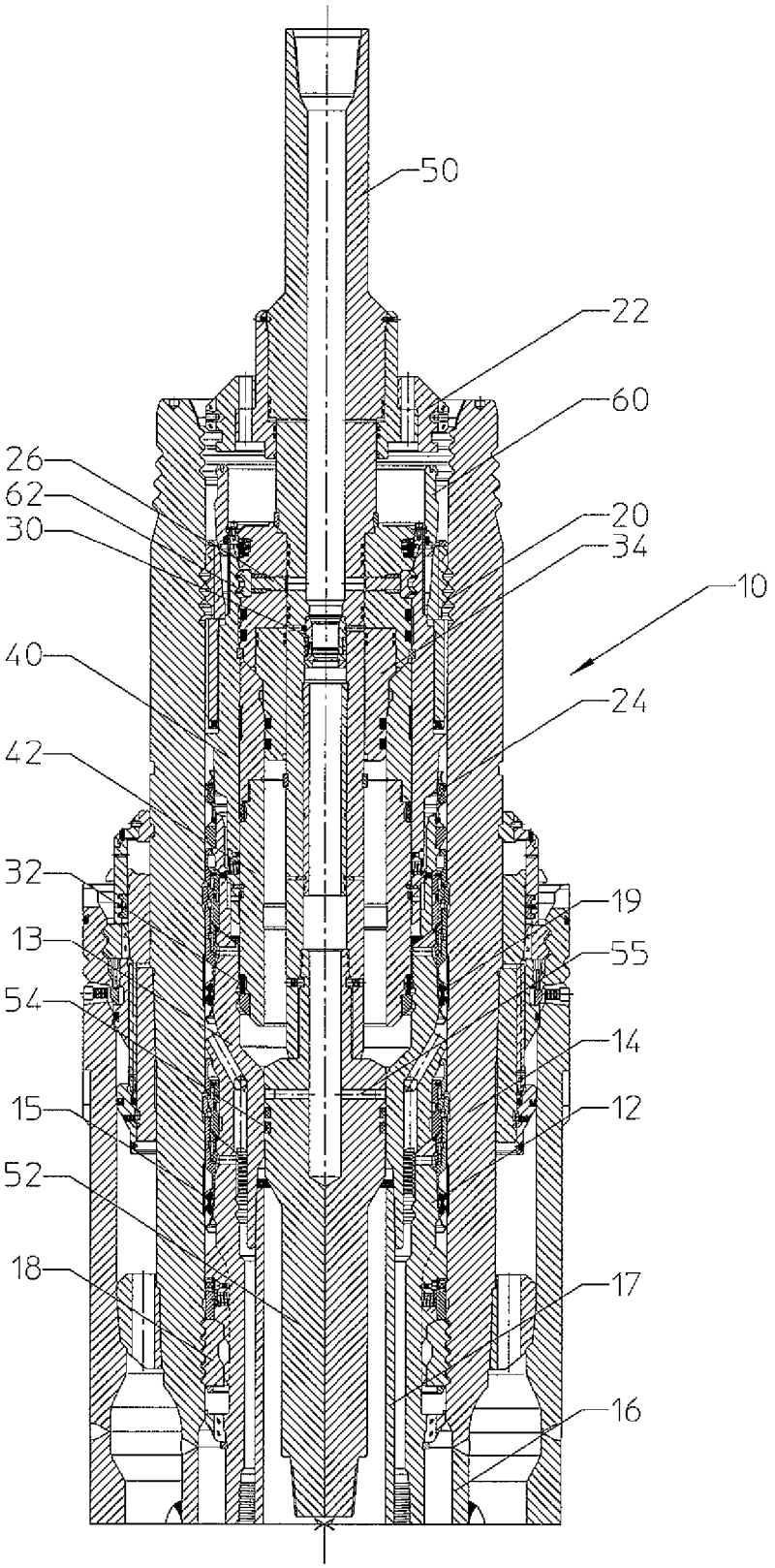
FIG. 2 is a cross-sectional view illustrating a portion of a wellhead, a casing hanger, and a running tool carrying a lockdown sleeve and run into the wellhead.

FIG. 2 illustrates the running tool 50 lowered into the wellhead 14 and positioned such that the lower end 52 of the running tool seals with the inner bore of the upper casing hanger 13 with one or more seals 54. The running tool carries a first piston 22 at its upper end which is used to secure the lockdown sleeve 40 to the wellhead, as described subsequently. The running tool also carries another piston 26 which temporarily locks the lockdown sleeve to the running tool. Yet another piston 34 supported on the running tool is used to energize the seal 32, as explained subsequently.

Figure 3:
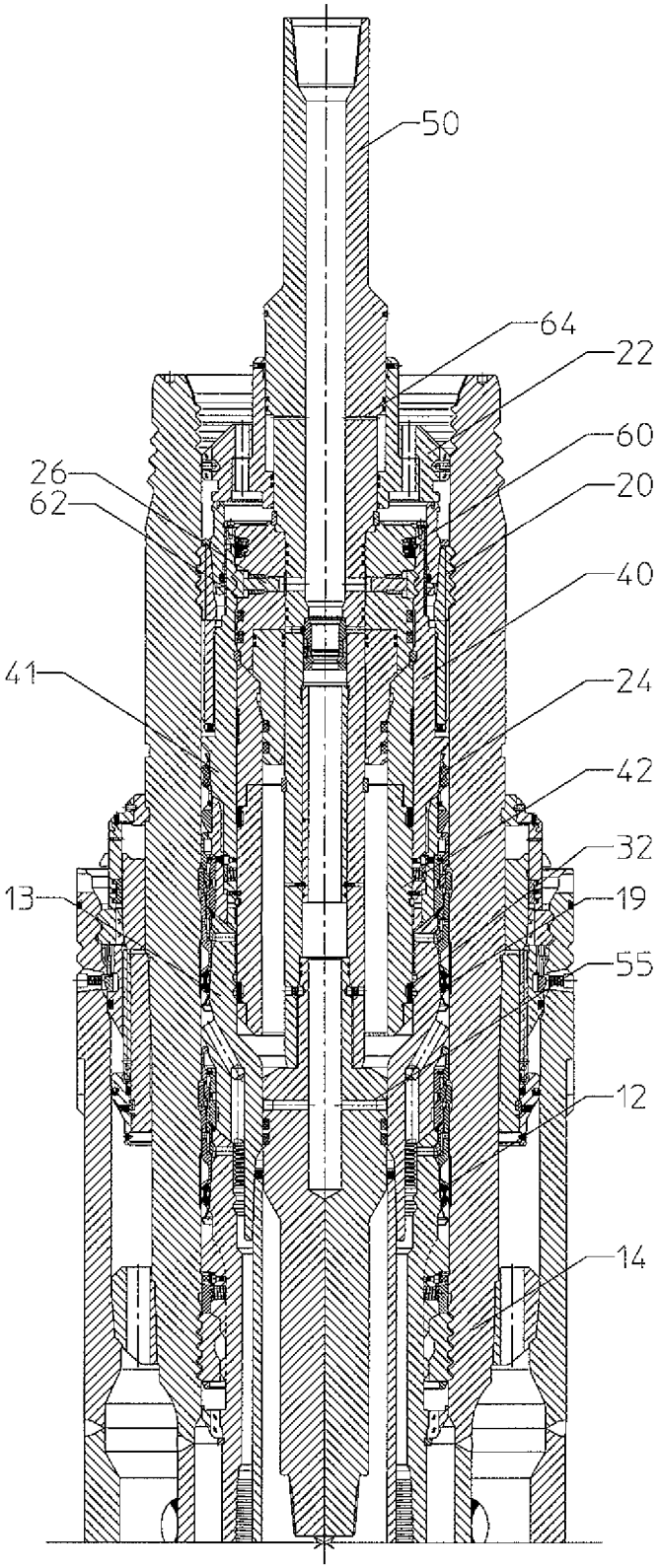
FIG. 3 illustrates the component shown in FIG. 1 with a lockdown piston activated to axially interconnect the lockdown sleeve and the wellhead.

Referring now to FIG. 3, the piston 22 has been activated by fluid pressure in the running tool passing through ports 64 to force the piston downward, thereby forcing activating sleeve 60 downward. The outer tapered surface of the actuating sleeve 60 engages the inner tapered surface on the lockdown C-ring 20, such that the outwardly projecting teeth or ridges on the lockdown ring engage corresponding grooves in the wellhead to axially fix the position of ring 20 and the lockdown sleeve 40 with respect to the wellhead. FIG. 3 also shows the piston 26 activated to move radially outward, thereby forcing the C-ring 62 outward to provide secured engagement between the lockdown sleeve 40 and the running tool 50. The pistons 22 and 26 may be simultaneously activated. Shear pins may be used on piston 22, however, to activate piston 26 prior to activating piston 22, or if desired subsequent to activating piston 26. The casing hanger seal 19 may have previously been set, and the seal 24 is properly positioned for sealing with the wellhead when the lockdown sleeve 40 lands on the casing hanger 13 and is locked to the wellhead 14, as discussed above.

For this embodiment, the sleeve 40 includes a lockdown body 41 and a seal sleeve 42 supported on the body 41. With the tool positioned as shown in FIG. 3, fluid pressure within the running tool may then be increased to pass through the ports 55 in the running tool and test both the seal 24 and the seal 19. Fluid from ports 55 passes upward between the casing hanger 13 and the seal sleeve 42, and below seal 24 and above seal 19. At this stage, the seal 32 is not energized and does not provide a seal between the lockdown body 41 and the seal sleeve 42 or casing hanger 13. The integrity of the seals 24 and 19 may be tested by insuring that a desired test pressure is maintained within the running tool. Piston 26 thus secures the running tool to the lockdown sleeve, which in turn is secured to the wellhead, during the test of seals 24 and 19.

Figure 4:
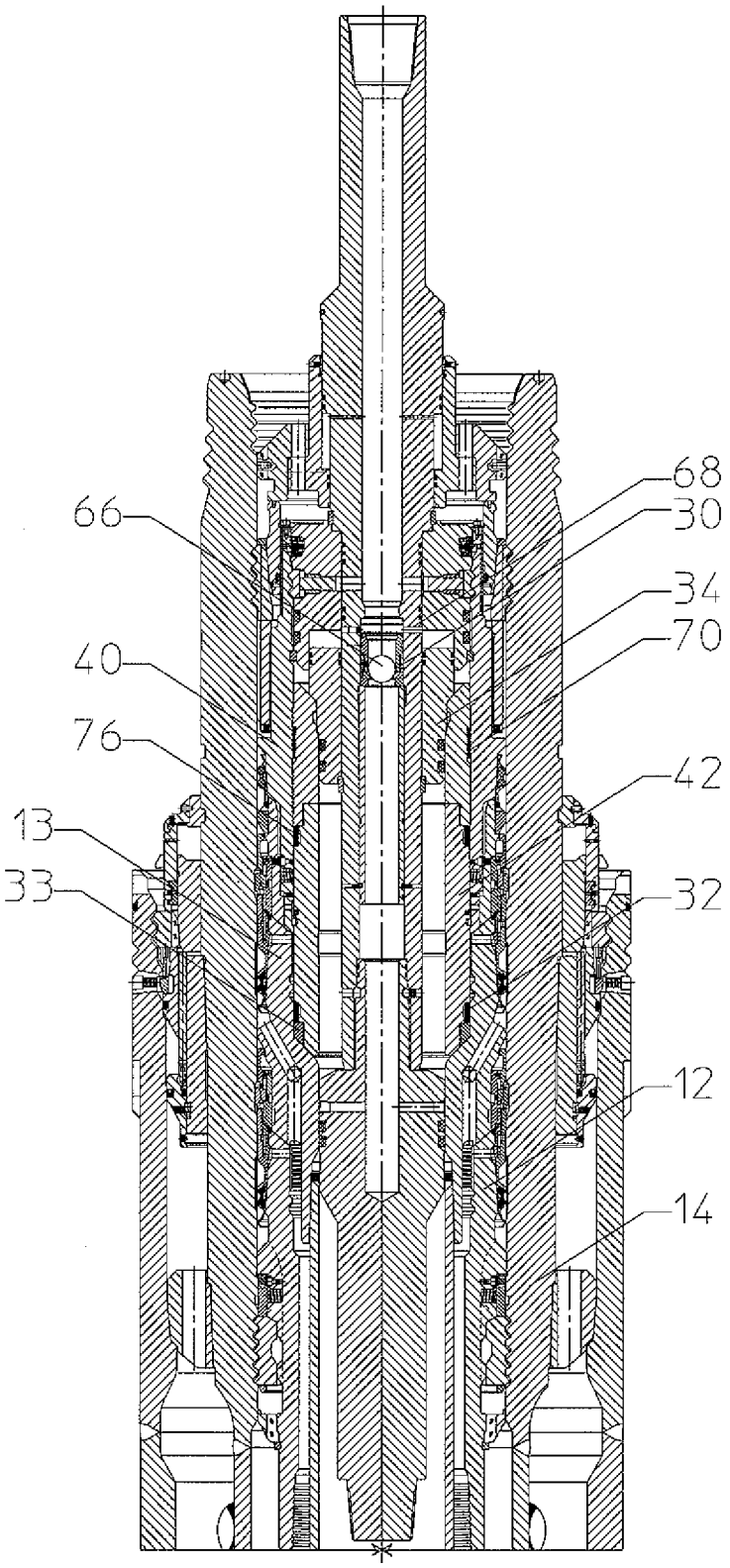
FIG. 4 is a cross-sectional view of the component shown in FIGS. 3, with a ball dropped on the ball seat.

As shown in FIG. 4, a ball or other closure 66 may then be dropped to land on seat 30, shearing a pin to force the seat to move downward and opening port 68, thereby exposing fluid pressure to piston 34. Downward movement of piston 34 in response to fluid pressure moves the seal sleeve 42 downward, thereby forcing the seal sleeve 42 into engagement with the casing hanger 13. More particularly, a seal retaining ring 33 engages the surface on the casing hanger 13 so that seal 32 seals with the ID surface of the hanger. During downward movement of the seal sleeve 42, a ratchet latch 70 acts between the seal sleeve 42 and the lockdown body 41 to allow downward movement, but prevent upward movement of the seal sleeve 42 with respect to the lockdown sleeve 40, thereby maintaining the integrity of seal 32 even when the energizing force of the piston 34 is removed. Another seal 76 is provided above seal 32, and seals between an inner surface on the lockdown sleeve and an outer surface on the seal sleeve 42.

Figure 5:
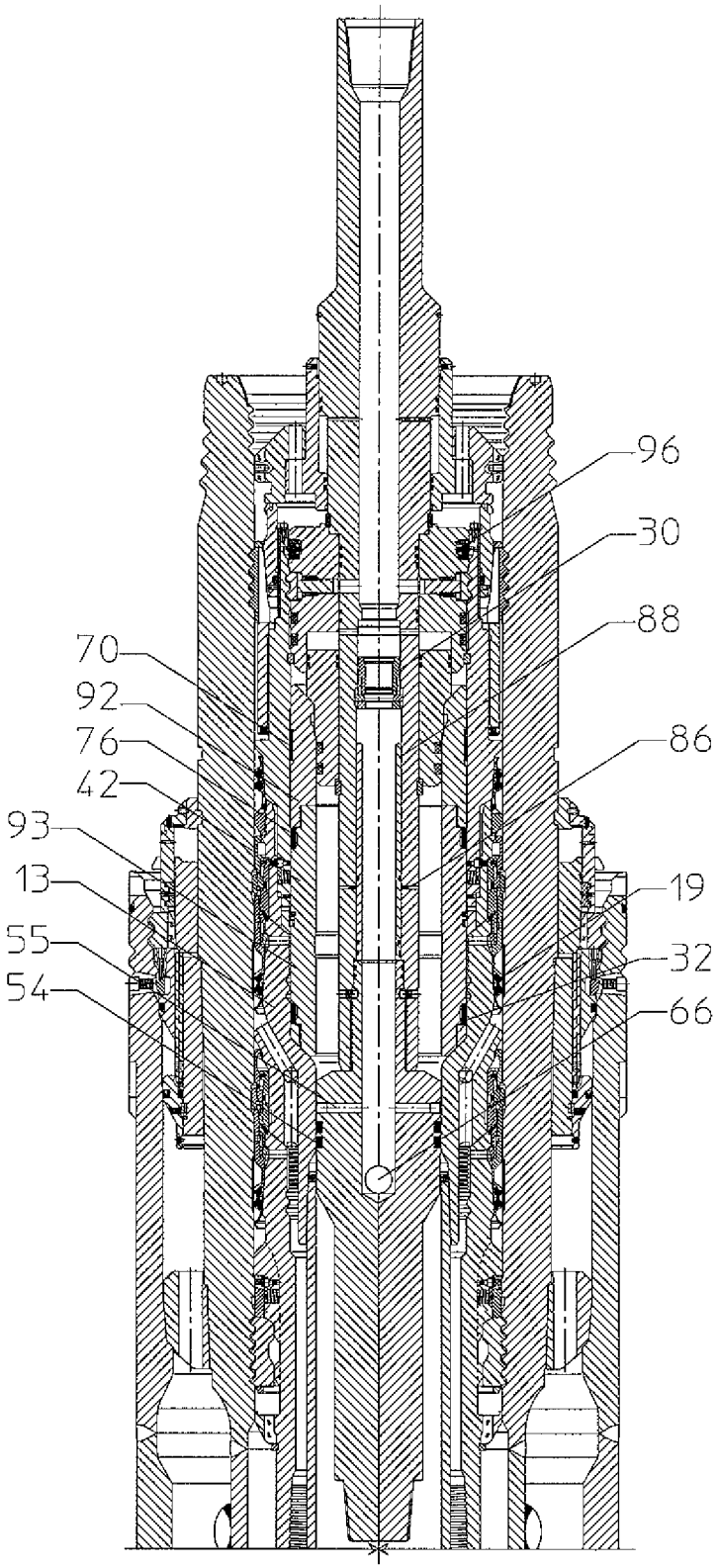
FIG. 5 is a cross-sectional view of the components shown in FIG. 4, with an energizing piston activated to energize a second seal.

As shown in FIG. 5, a subsequent operation may increase fluid pressure in the running tool to shear pins 86, which hold seat closure 88 upward to limit downward movement of the seat 30. Shearing pins 86 allows the seat 30 to move downward and thereby allows the ball 66 to pass through the seat 30. With the ball removed from the seat, fluid may again pass through the ports 55 above the seals 54 in the running tool, so that the integrity of the seals 32 and 76 can be tested. More particularly, test pressure is applied from the bottom to the seal 32 which seals between the seal sleeve 42 and the casing hanger 13. The seal sleeve 42 consists of upper sleeve 92 which carries the retch latch 70 and a lower sleeve 93 which carries the seals 32 and 76. The upper sleeve 92 is structurally separate from the lower sleeve 93, as shown in FIG. 5, and fluid pressure within the interior of the seal sleeve 40 may thus pass radially outward in the gap between the end faces of the sleeves 92 and 93, so that the upper seal 76 is tested from above. Once these seals are tested, fluid pressure may be decreased and the running tool retrieved. During retrieval, locking piston 26 is forced radially inward by upward movement of running tool, and shear pins 96 that hold the running tool to the lockdown sleeve are sheared. The lockdown sleeve remains secured to the wellhead with redundant seals in place.

Figure 6:
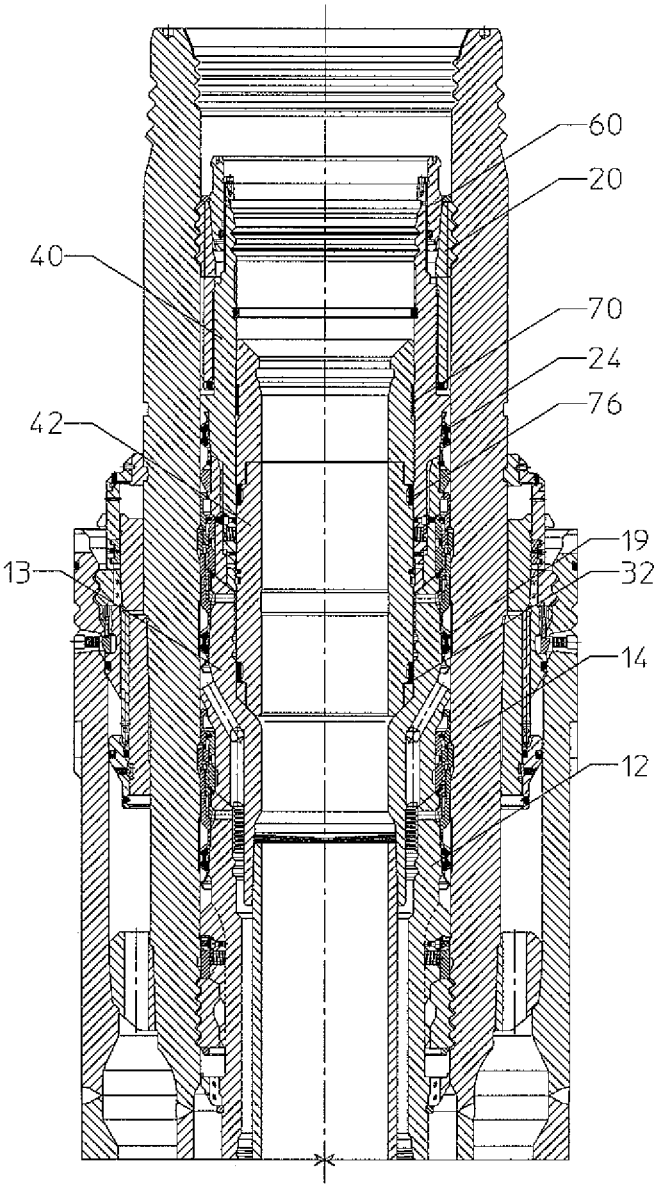
FIG. 6 is a cross-sectional view of the lockdown sleeve and related components remaining in the well.

FIG. 6 shows in greater detail the components remaining in the well once the running tool is retrieved, including the actuating ring 60 which moved downward in response to movement of the piston 22 on running tool 50, causing the locking ring 20 to engage the interior grooves in the wellhead. The ratchet latch 70 is shown in greater detail in FIG. 6, and prevents upward movement of the seal sleeve 42 with respect to lockdown sleeve 40. A third seal 76 seals between the seal sleeve 42 and lockdown sleeve 40, along with the seal 32 discussed above. Seal 24 remains a redundant seal to seal 19, each sealing the casing annulus.

FIG. 6 illustrates the wellhead with the lockdown sleeve secured in place and the running tool retrieved to the surface. The lockdown ring 20 prevents upward movement of the casing hanger 13 within the wellhead 14 in response to either fluid pressure in the well and/or thermal expansion of the casing while downhole. The combination of seals 19, 24, 32, and 76 provide redundant sealing and therefore increased safety.

Figure 8:
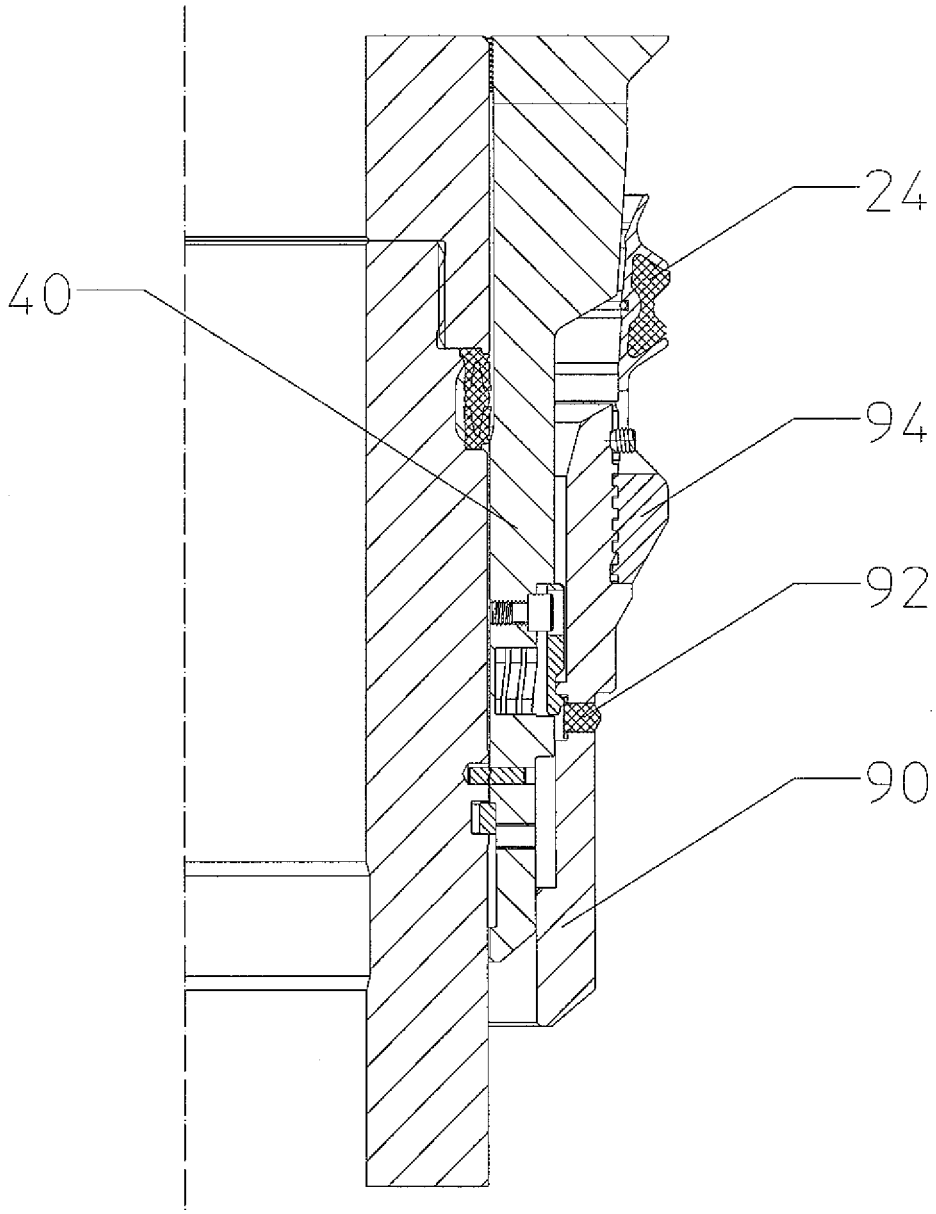
FIG. 8 is an enlarged view of the mechanism for controllable release of the first redundant seal.

Referring now to FIG. 8, an enlarged view of the mechanism for setting the seal 24 is depicted. The running tool lands on the casing hanger with sleeve 90 supporting the seal 24. The lower end of the sleeve 90 thus engages the upper end of casing hanger 13, as shown in FIG. 2. A series of circumferentially spaced buttons 92 prevent axial movement of the sleeve 90 and the seal 24 with respect to the lockdown sleeve 40 when run-in the well. Upset 94 below seal 24 physically protects the seal as it is run in the well. The application of set down weight causes the buttons 92 to engage the lockdown sleeve 40 and thereby release the sleeve 90 and the seal 24 from the lockdown sleeve 40, so that the lockdown sleeve 40 can move down behind the seal 24.

When in this position, the seal 24 becomes fully supported by the lockdown sleeve and reliably seals with the wellhead.

Figure 7:
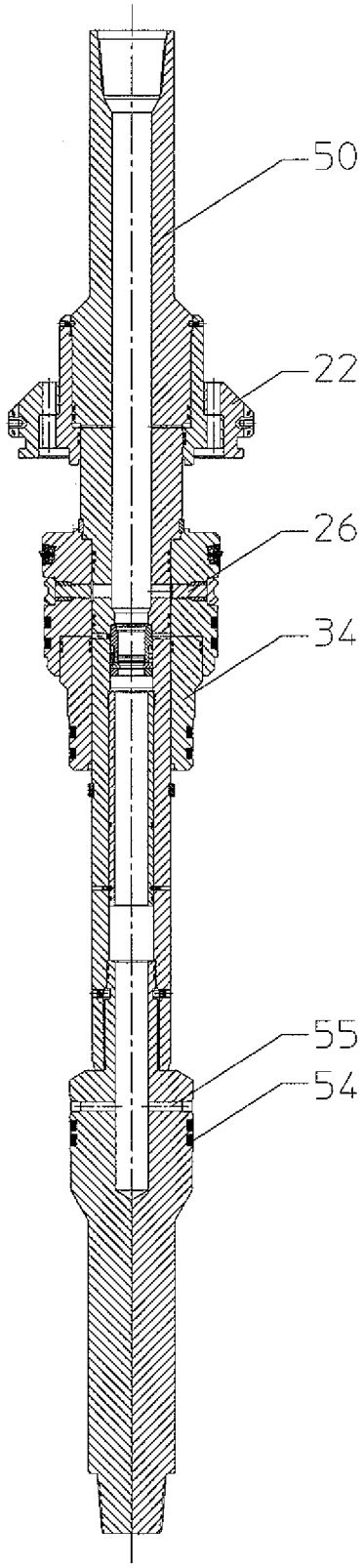
FIG. 7 is a cross-sectional view of the running tool.

FIG. 7 illustrates the running tool 50 carrying the lockdown piston 22, the piston 26 which locks the running tool to the lockdown sleeve, and the piston 34 which energizes the seal 32. Flow through ports 55 and seals 54 have been discussed earlier. The running tool as shown in FIG. 7 is retrieved to the surface, but can be reinstalled if desired to retrieve the lockdown sleeve or to re-test the sleeve seal 30.

Those skilled in the art will appreciate that, as a practical matter, the seal 32 and the seal 24 should not be simultaneously set, since fluid pressure would effectively become trapped during the simultaneous seal setting operation. In the embodiment discussed above, the seal 24 is first positioned for sealing with the wellhead, and the seals 19 and 24 are tested before the seals 32 and 76 are engaged. In other applications such as described below, the seal 32 may be engaged before the seal 24 is energized.

Figure 9:
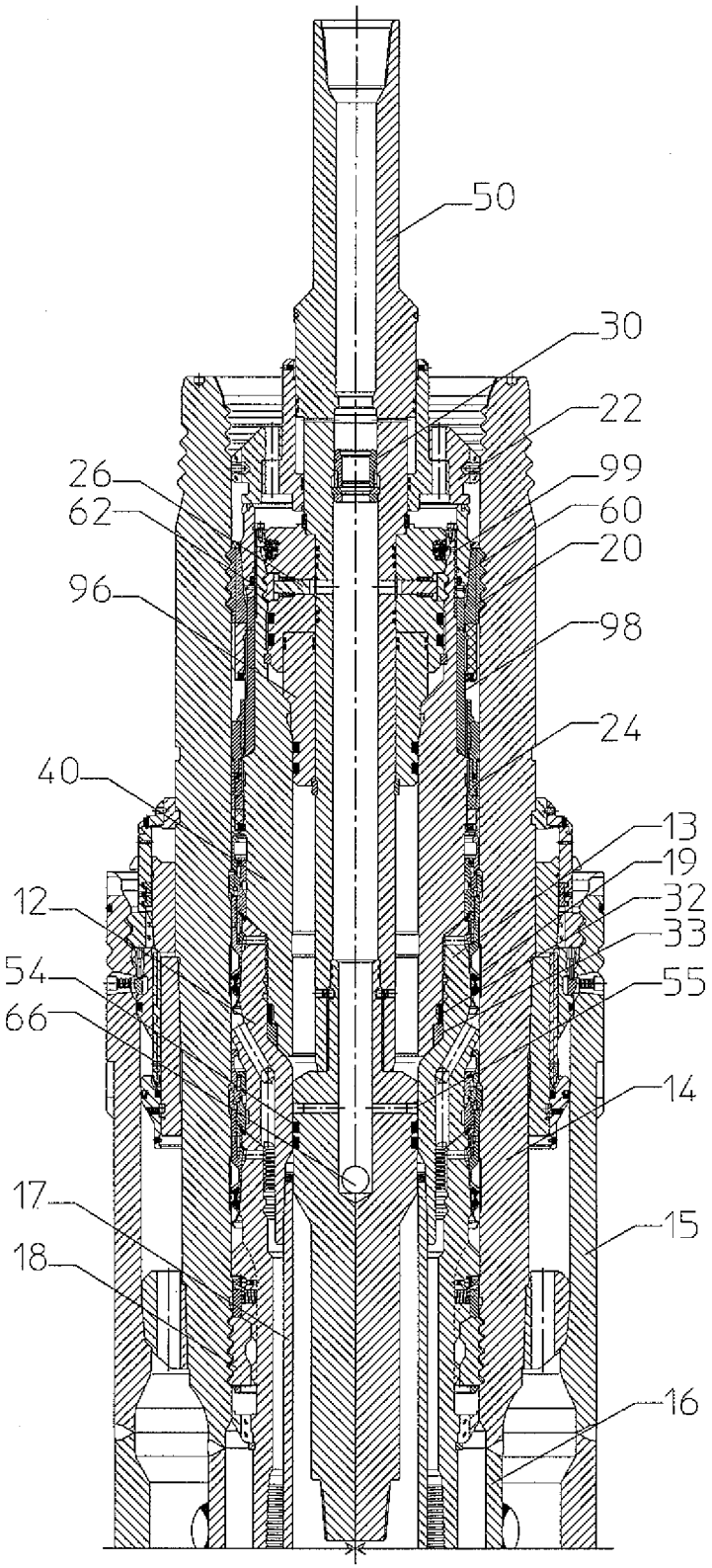
FIG. 9 depicts an alternative running tool which sets a seal between the lockdown sleeve and the casing hanger before setting the seal between the lockdown sleeve and the wellhead.

FIG. 9 depicts an alternative running tool and lockdown sleeve, wherein the seal 32 is energized before the seal 24. In this embodiment, the casing hanger 13 includes a seal 19 as previously described, and the lower end of the running tool includes test ports 55 above the seals 54. The casing hanger is already landed and supported on the wellhead with C-ring 18, and if desired the seal 19 may be tested with the running tool which positioned the casing hanger within the wellhead. The embodiment as shown in FIG. 9 include the lockdown piston 22 and a locking piston 26 as previously described for locking the lockdown sleeve 24 to the wellhead, and for locking the running tool to the lockdown sleeve. A replaceable bushing 96 replaces the seal sleeve in the prior embodiment, and does not act as a piston and instead seals with the interior of the lockdown sleeve 40 and the running tool 50. Bushing 96 may be configured to seal with a specific casing hanger and a specific lockdown sleeve. When operating the assembly as shown in FIG. 9, the lockdown sleeve 40 may engage and seal with an inner surface on the casing hanger 13. No seal sleeve similar to sleeve 42 need be provided. The lockdown sleeve 40 lands on the casing hanger and seal 32 seals with an ID surface on the casing hanger. Once the lockdown sleeve is landed, seal 32 may be tested by passing pressure through the seat 30 and through the test ports 55. A designated pressure level maintained in the running tool insures that the seal 32 is reliably set. If not properly set, the running tool and lockdown sleeve may be retrieved to the surface and repaired or replaced.

Assuming that the test of seals 32 and 76 is satisfactory, ball 66 may then be dropped down the running string to land on the ball seat 30 and seal off the bore in the running tool mandrel below the seat 30. The application of fluid pressure above the seated ball will (1) lock piston 26 to the lockdown sleeve 40, (2) move the piston 22 downward, thereby moving sleeve 60 downward and moving ring 20 outward to lock the lockdown sleeve to the wellhead, and (3) shear pins to release the ball seat from its run-in position on the running tool mandrel. An increase in fluid pressure will shear pins in the ball seat and allow the ball seat to drop, thereby dropping the ball from the seat and exposing fluid pressure to the piston 26, which energizes the ring 62 and thereby locks the running tool to the lockdown sleeve.

Downward movement of the lockdown piston 22 moves the actuating sleeve 60 downward to energize the split lock ring 20, as discussed above. The action of moving the sleeve 60 downward simultaneously pushes seal sleeve 98 downward, thereby actuating seal 24. Seal 24 may include a long nose piece to energize the seal. The seal may have a mating pocket to receive the nose piece. With the lockdown sleeve locked down, the integrity of seal 24 may be tested by closing the BOP rams above the wellhead and applying fluid through choke and kill lines to test the seal 24. When seal tests have been completed, the BOP rams may be opened and the running tool retrieved by picking up on the running tool, thereby shearing the pins 99 that interconnect the running tool and the lockdown sleeve. The running tool may then be removed with the lockdown sleeve in place and redundant barriers to the casing hanger seal 24. The FIG. 9 embodiment does not require an axially movable seal sleeve, and only seals 32 and 24 need to be tested, preferably in that sequence.

The method of securing a casing hanger within a wellhead and sealing an annulus between the casing and the wellhead should be apparent from the above description. A seal is supported on the casing hanger for sealing between the casing hanger and the wellhead. A lockdown sleeve is positioned in the wellhead to limit axial movement of the casing hanger and thereby fixes the casing hanger to the wellhead. The running tool is actuated to lock the lockdown sleeve to the wellhead. The first redundant seal carried on the running tool is used to seal the casing annulus by sealing between the lockdown sleeve and the wellhead. A second seal seals between the casing hanger and either the lockdown sleeve (FIG. 9) or with the seal sleeve 42 carried by the lockdown sleeve (FIG. 6). The seal sleeve 42 in FIG. 6 is operationally part of the lockdown sleeve, so that the FIG. 6 seal 32 functionally seals between the lockdown sleeve and the casing hanger.

A ball seat may be axially movable within the running tool, and axial movement of the ball seat exposes pressure to an energizing piston which moves to create a seal between the seal sleeve and the casing hanger with the second redundant seal. The second seal may be activated by the energizing piston movable in response to fluid pressure in the running tool.

Lockdown piston 22 may be used as part of the running tool to exert an actuating force on the lockdown ring 20, thereby forcing the ring outward into grooves provided in the wellhead and securing the lockdown sleeve to the wellhead. For many applications, a C-shaped ring 20 is preferred to secure the lockdown sleeve to the wellhead, in part due to high reliability of the C-shaped ring 20 and the significant axial load that may be carried between the wellhead and the lockdown sleeve by the ring 20. Other mechanisms may be used for energizing a lockdown ring, including techniques which accomplish a downward force on a sleeve similar to actuating sleeve 60 by rotating the drill string in a certain direction, which cooperates with other members to move an actuating sleeve or similar component downward, thereby forcing the locking ring 20 radially outward. In other applications, a controlled set down weight may be used to force the actuating sleeve or similar component downward, thus forcing the C-ring 20 outward. Other actuating systems may use a C-ring which is biased radially outward and run-in the well with a reduced diameter, and then released to move radially outward into the grooves in the wellhead.

Radially movable piston 26 is suitable for connecting the lockdown sleeve and the running tool, and significant force is not required to keep the running tool in place. In the absence of fluid pressure to the piston 26, the taper on the circumferentially spaced dogs allows the piston 26 to retract with an upward pull on the running tool.

Energizing piston 34 as disclosed herein is suitable for moving the seal sleeve downward and energizing the seal 32, although rotation of the drill string and/or a controlled set down weight may alternatively be used to force the seal sleeve downward and thereby energize the seal 32. A locking piston 26 is a preferred technique for interconnecting the running tool with the lockdown sleeve with the connection ring 62, which may be used in some applications during test of the seals, but is not required in other applications. Various mechanisms other than a radially movable piston may be used to interconnect the running tool and the lockdown sleeve.

The preferred embodiment of running tool as disclosed herein includes a seat, such that a ball or other closure lands on the seat to control fluid pressure below the seat. The seat is axially movable such that seat movement releases the ball or closure. Mechanisms other than ball seats and closures may be used for this purpose, including burst discs and rupture discs which, when exposed to a selected pressure level, may rupture to expose pistons or other mechanisms to high fluid pressure.

In a preferred embodiment, the ball seat when run in with the running tool initially blocks pressure to the energizing piston. The pressure in the running tool is thus responsive to a ball landing on the ball seat then moving the ball seat down. The ratch latch mechanism maintains an energizing force on the second seal after the energizing piston is removed from the wellhead. For embodiments when the second seal 32 and third seal 76 are provided, each seal has substantially the same sealing area (diameter), so that pressure lock problems are avoided and the lockdown sleeve is not subject to high forces if the casing hanger seal 19 were to leak. If pressure were to leak by the casing hanger seal 19, the substantially uniform sealing diameters of the seals 32 and 76 prevents any significant axial force on the seal sleeve. Various types of seat closures may be used instead of a ball, including a dart or plug. Also, the ball could be released from the seat by radial expansion of the seat in response to high fluid pressure.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A lockdown mechanism and running tool for securing a casing hanger within a wellhead and sealing an annulus between a casing supported by the casing hanger and the wellhead, comprising:

the casing hanger supporting a hanger seal for sealing between the casing hanger and the wellhead;

a lockdown sleeve positioned in the wellhead by the running tool for limiting axial movement of the casing hanger by axially securing the casing hanger to the wellhead;

a first redundant seal fluidly in series with the hanger seal for sealing between the lockdown sleeve and the wellhead;

a second redundant seal fluidly in series with the hanger seal for sealing between the lockdown sleeve and the casing hanger, thereby sealing the annulus between the casing and the wellhead; and the running tool is actuated to energize at least one of the first redundant seal and the second redundant seal;

the running tool including a locking piston moveable in response to fluid pressure in the running tool to temporarily lock the lockdown sleeve to the running tool while the first redundant seal is tested; and a ratch latch mechanism for maintaining the second redundant seal in position after the running tool is removed from the wellhead.

2. The lockdown mechanism and running tool as defined in claim 1, wherein the running tool includes a lockdown piston moveable in response to fluid pressure in the running tool to lock the lockdown sleeve to the wellhead.

3. The lockdown mechanism and running tool as defined in claim 1, wherein the running tool includes an energizing piston moveable in response to fluid pressure in the running tool to energize the second redundant seal.

4. The lockdown mechanism and running tool as defined in claim 3, wherein a ball seat when run in with the running tool initially blocks pressure to the energizing piston.

5. The lockdown mechanism and running tool as defined in claim 1, further comprising:

a ball seat axially moveable within the running tool, and fluid pressure in the running tool is responsive to a closure dropped through a running string and landing on the ball seat.

6. The lockdown mechanism and running tool as defined in claim 5, wherein the ball seat is axially moved to release a closure.

7. The lockdown mechanism and running tool as defined in claim 1, wherein the running tool activates an actuation sleeve to lock the lockdown sleeve to the wellhead and positions the first redundant seal for sealing between the lockdown sleeve and the wellhead.

8. The lockdown mechanism and running tool as defined in claim 1, wherein the lockdown sleeve includes a lockdown sleeve body and a seal sleeve supported on the body and having an upper sleeve containing the ratch latch mechanism, and a lower sleeve supporting the second redundant seal.

9. The lockdown mechanism and running tool as defined in claim 1, further comprising:

a third seal sealing between the lockdown sleeve body and a seal sleeve, the second redundant seal and the third seal having substantially the same sealing area.

10. The lockdown mechanism and running tool as defined in claim 1, wherein the lockdown sleeve lands on the casing hanger to seal between the lockdown sleeve and the casing hanger with the second redundant seal.

11. The lockdown member and running tool as defined in claim 1, wherein the running tool is actuated to lock the lockdown sleeve to the wellhead.

12. The lockdown mechanism and running tool as defined in claim 1, wherein each of the first redundant seal and the second redundant seal is separately tested before the running tool is retrieved.

13. A lockdown mechanism and running tool for securing a casing hanger within a wellhead and sealing an annulus between a casing supported by the casing hanger and the wellhead, the casing hanger supporting a hanger seal for sealing between the casing hanger and the wellhead, the lockdown mechanism comprising:

a lockdown sleeve body positioned in the wellhead by the running string for limiting axial movement of the casing hanger by axially securing the casing hanger to the wellhead;

a first redundant seal fluidly in series with the hanger seal sealing between the lockdown sleeve and the wellhead;

a seal sleeve movable with respect to the lockdown sleeve body;

a second redundant seal fluidly in series with the hanger seal and actuated for sealing between the seal sleeve and the casing hanger after the first redundant seal is actuated; and a running tool including a locking piston moveable in response to fluid pressure in the running tool to temporarily lock the lockdown sleeve to the wellhead and the running tool while the first redundant seal is tested, wherein the running tool; and a ratch latch mechanism for maintaining the second redundant seal in position after the running tool is removed from the wellhead.

14. The lockdown mechanism as defined in claim 13, further comprising:

the seal sleeve includes an upper sleeve containing the ratch latch, and a lower sleeve supporting the second redundant seal and a third seal.

15. The lockdown mechanism and running tool as defined in claim 13, wherein the lockdown sleeve body lands on the casing hanger to seal between the lockdown sleeve and the casing hanger with the second redundant seal.

16. The lockdown mechanism and running tool as defined in claim 13, wherein a running tool activates the lockdown sleeve body and positions the first redundant seal for sealing between the lockdown sleeve body and the wellhead.

17. A method of securing a casing hanger within a wellhead and sealing an annulus between a casing supported by the casing hanger and the wellhead, comprising:

supporting a hanger seal on the casing hanger for sealing between the casing hanger and the wellhead;

positioning a lockdown sleeve in the wellhead for limiting axial movement of the casing hanger to the wellhead;

connecting the lockdown sleeve to the wellhead;

sealing between the lockdown sleeve and the wellhead with a first redundant seal;

sealing between the lockdown sleeve and the casing hanger with a second redundant seal; and actuating a running tool to actuate the second redundant seal after actuating the first redundant seal;

wherein a locking piston is moveable in response to fluid pressure in the running tool to temporarily lock the lockdown sleeve to the running tool while the first redundant seal is tested; and providing a ratch latch mechanism for maintaining an energizing force on the second and third redundant seal after the running tool is removed from the wellhead.

18. The method as defined in claim 17, wherein the running tool activates the lockdown sleeve and positions the first redundant seal for sealing between the lockdown sleeve and the wellhead.

19. The method as defined in claim 17, wherein fluid pressure in the running tool is responsive to a closure dropped through a running string and landing on a ball seat.

20. The method as defined in claim 17, further comprising: the second redundant seal is tested after the first redundant seal is tested.

21. The method as defined in claim 17, wherein the lockdown sleeve lands on the casing hanger to seal between the lockdown sleeve and the casing hanger with the second redundant seal.

22. The method as defined in claim 17, further comprising: the first redundant seal is tested after the second redundant seal is tested.

* * * * *